United States Patent [19]

Takimoto et al.

[11] 4,168,643

[45] Sep. 25, 1979

[54] WEB SLITTER WITH PRESSER ROLL

[75] Inventors: Hisashi Takimoto; Akira Yamaguchi, both of Odawara, Japan

[73] Assignee: Fuji Photo Film Co., Ltd., Minami-ashigara, Japan

[21] Appl. No.: 850,103

[22] Filed: Nov. 9, 1977

[30] Foreign Application Priority Data

Nov. 10, 1976 [JP] Japan ..... 51-134921

[51] Int. Cl.[2] ..... B26D 1/24

[52] U.S. Cl. ..... 83/422; 83/430; 83/500

[58] Field of Search ..... 83/500, 501, 502, 430, 83/436, 435, 425.3, 425.2, 426, 422

[56] References Cited

U.S. PATENT DOCUMENTS

| | | | |
|---|---|---|---|
| 612,703 | 10/1898 | Clark | 83/430 X |
| 801,916 | 10/1905 | Rudolphi | 83/430 |
| 852,375 | 4/1907 | Carlton | 83/426 X |
| 1,825,223 | 9/1931 | Deck | 83/430 |
| 2,327,468 | 8/1943 | Stocker | 83/426 X |
| 2,815,077 | 12/1957 | Pechy | 83/500 X |
| 3,122,040 | 2/1964 | Bishop | 83/430 X |

*Primary Examiner*—Frank T. Yost

*Attorney, Agent, or Firm*—Sughrue, Rothwell, Mion, Zinn and Macpeak

[57] ABSTRACT

A slitter for cutting lengthwise a wide and flexible web into a predetermined width is provided with a press roller in which a resilient outer peripheral surface may be pressed against an outer peripheral surface of the lower cutting edge under predetermined pressure. The press roller has a resilient body having a rubber hardness of 20 to 80 degrees and which is finished to a surface roughness of 10 to 50 $\mu$ H max.

4 Claims, 5 Drawing Figures

WEB SLITTER WITH PRESSER ROLL

BACKGROUND OF THE INVENTION

The present invention relates to a web slitter, and more particularly to a slitter for cutting lengthwise a wide and flexible web into a predetermined width.

The web used in the present invention includes generally flexible web-like materials 1μ to 1000μ in thickness and 0.03 m to 3 m in width made of polyvinyl chloride, polycarbonate, ABS resin, polyethylene terephtalate, cellulose triacetate paper, synthetic paper or the like, and those materials using said web-like materials as a support, to one surface or both surfaces of which is applied a coating film, in layered fashion, for example, such as a photosensitive layer, a magnetic layer, an adhesive layer, a protective layer, a sliding layer, a colored layer, and the like.

A prior art web slitter for cutting (hereinafter referred to as "slitting") lengthwise the aforesaid webs into a predetermined narrow width is generally illustrated in FIGS. 1 and 2. The principal mechanism of this web slitter comprises a plurality of thin-wall circular upper cutting edges 5 located upwardly of a web 1 and supported on a support shaft 2. The upper cutting edges 5 are disposed across said web 1 with a spacing P corresponding to a predetermined slit width and are held and fixed in position by holders 3 each of which has an annulus that project through a central hole of a circular cutting edge and a mating pusher plate 4. The same number of circular lower cutting edges 7 as said upper cutting edges 5 are located downwardly of said web 1 and supported on a support shaft 6 disposed across said web 1 with an outer peripheral width corresponding to said spacing P.

The lower cutting edges 7 are rotated in a clockwise direction as indicated by arrow CW for the purpose of conveying said web 1 in the direction of arrow A while supporting said web 1 to be slitted on the outer peripheral surface thereof. The nose surfaces of said upper cutting edges 5 are rotated in a counter-clockwise direction as indicated by arrow CCW and brought into sliding contact with the corresponding edge surfaces of the lower cutting edges thereby slitting the web 1 passing through the sliding contact point therebetween into a predetermined width.

While the prior art slitter performs satisfactorily under conditions of low speeds and high tensions of the web, it has proved unsatisfactory under high speed production conditions. More specifically, the following disadvantages have developed:

(1) When the conveying speed of the web 1 is increased, a thin layer of air is entrained into the zone of contact between said web 1 and the lower cutting edge 7 as the web 1 moves, resulting in a floating of said web by the entrained air of several microns at most. As a consequence, the web 1 tends to be moved laterally in a zigzag fashion towards the moving direction, and as a result, the web 1 to be slitted is often slitted in a greatly zigzag state with respect to the normal slitting direction.

(2) Particularly, when a web of photographic film is slitted in a greatly zigzag state as previously mentioned, it becomes extremely difficult to accurately make holes in a predetermined position in the proximity of the edge. Further, in the case of video magnetic tape, a regenerative image thereof is materially distorted.

(3) Where the web 1 is thin and the coating film is high in pressure sensitive properties, the above-mentioned zigzag phenomenon is further developed when the tension of the web 1 is set to an extremely low level and therefore, it is necessary to set also the conveying speed of the web 1 to a lower value to prevent occurrence of the air stream as described above. As a consequence, the operating efficiency is considerably reduced.

SUMMARY OF THE INVENTION

The present invention overcomes the limitations noted above with respect to prior art slitters by providing a slitter which can slit the web 1 while conveying it at high speeds and in a stable condition.

The above-mentioned object may be accomplished in the present invention by a web slitter for cutting a web into a predetermined width by means of sliding contact between edge surfaces of rotatably supported circular upper and lower cutting edges, further comprising a press roller in which a resilient outer peripheral surface may be pressed against an outer peripheral surface of said circular lower cutting edge under a predetermined pressure.

DESCRIPTION OF THE PREFERRED EMBODIMENTS

In the following, one embodiment of a web slitter in accordance with the present invention will be described in conjunction with the accompanying drawings.

Figure 3:
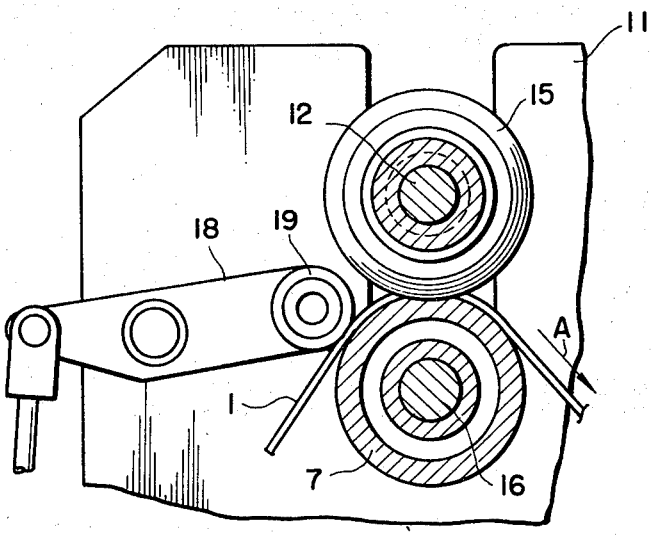
FIG. 3 is a side view showing a principal part of a web slitter in accordance with the present invention.
Figure 4:
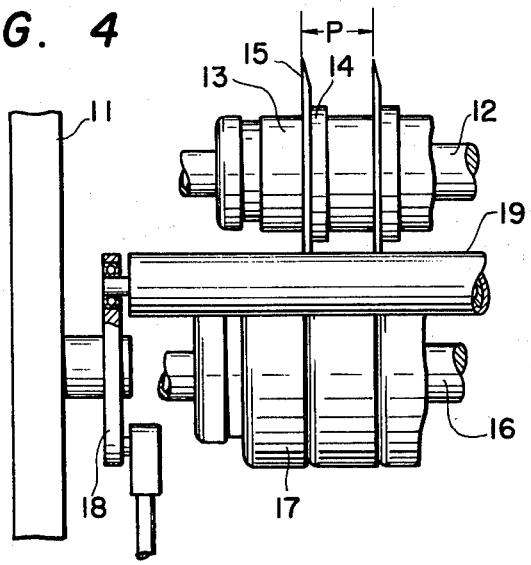
FIG. 4 is a front view of FIG. 3.

As illustrated in FIGS. 3 and 4, a principal part 10 of the web slitter in accordance with the present invention comprises a support shaft 12 disposed upwardly of a web 1 conveyed at a predetermined speed in a direction of arrow A. A support shaft 12 is supported at opposite ends thereof rotatably and detachably by means of a side frame 11. Plural sets of mating holders 13 and pusher plates 14 supported on said support shaft 12 with a spacing P corresponding to a predetermined slit width fixedly hold a plurality of thin-wall circular upper cutting edges 15. A support shaft 16 is located downwardly of said web 1 and across said web 1, and has its opposite ends rotatably and detachably supported by said side frame 11. The same number of circular lower cutting edges 17 as said upper cutting edges 15 are supported on said support shaft 16 with an outer peripheral width corresponding to said spacing P. An arm 18 is pivotally supported on said side frame 11, and a press roller 19 is rotatably supported on the foremost end of said arm 18. An actuator (not shown) is connected to the rear end of said arm 18 to pivot and displace said arm 18 and press roller 19.

It will be noted that the axes of the support shafts 12 and 16 are positioned so that an edge surface of the upper cutting edges 15 comes into sliding contact with an edge of the outer peripheral surface of said lower cutting edges 17. The support shaft 12 is driven in such a manner that the edges of the upper cutting edges 15 are rotated with respect to the web 1 at a peripheral speed equal to or slightly higher than the web 1, and the support shaft 16 is driven in such a manner that the outer peripheral surface of the lower cutting edges 17 are rotated with respect to the web 1 at a speed equal to that of said web 1.

The above-mentioned press roller 19 has an outer peripheral member composed of a resilient body such as natural rubber, silicone rubber, nitrile rubber, ehtylene propylene rubber, urethane rubber, neoprene rubber, etc., which are relatively resilient and of which the rubber hardness is of the order of 20 to 80 degrees as defined by Japanese Industrial Standard JIS K 6301. The outer peripheral surface of the press roller 19 has its surface finished to have roughness of 5 to 70 $\mu$H max as defined by Japanese Industrial Standard JIS B 0601. Further, the outer peripheral surface of the press roller 19 is supported so as to uniformly come into contact in a direction of web width onto an outer peripheral surface on the upstream side of the lower cutting edges 17 supporting the web 1 on the outer peripheral suface thereof and is positioned to be returned to a waiting position without abutment with the upper cutting edges 15 when the upper and lower cutting edges 15 and 17 are removed.

In operation, in order to introduce the web 1, to which a relatively low tension is applied, between the upper and lower cutting edges 15 and 17 to convey the web 1 in a direction of arrow A, the upper and lower cutting edges 15 and 17 are rotated at a predetermined speed and thereafter, the actuator is operated to displace the press roller 19 from the waiting position towards the outer peripheral surface on the upstream of the lower cutting edge 17, whereby the web 1 immediately before being slitted is pressed under a predetermined pressure, normally less than 50 Kg/m, by the press roller 19 against the outer peripheral surface of the lower cutting edges 17. Air entrained towards the outer peripheral surface on the upstream of the lower cutting edges 17 together with the web 1 is cut off in its flow at a nip point of the press roller 19, and thereafter entry of air into the outer peripheral surface of the lower cutting edges 17 is prevented. Since the outer peripheral member of the press roller 19 has a resilient property as previously described and finished to a surface of appropriate roughness, the member can press the web 1 under uniform pressure and rotate at a peripheral speed substantially equal to that of the web 1 without impairing the quality of the web. The action of the press roller prevents the harmful propagation of variations in web tension so that the outer peripheral surface of the lower cutting edges 17 supports and guides the web 1 in a stable manner without allowing it to be moved in a zigzag fashion to the point in sliding contact with the edge surface of the upper cutting edges 15 thereby slitting the web 1 in a normal direction into a predetermined width.

Figure 1:
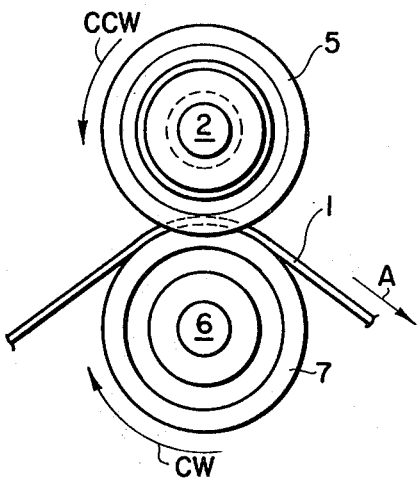
FIG. 1 is a side view showing a principal part of a conventional web slitter.
Figure 2:
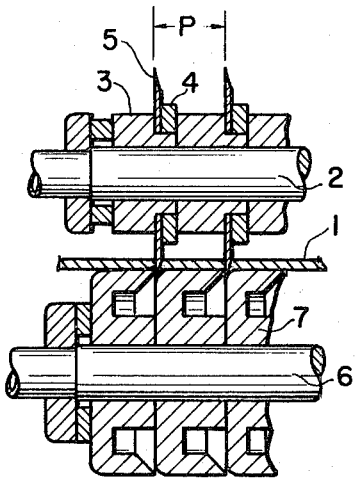
FIG. 2 is a front view of FIG. 1.
Figure 5:
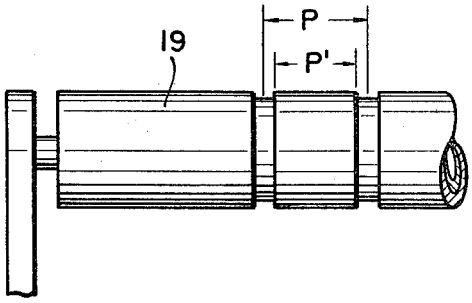
FIG. 5 is a front view showing a modified form of a press roller.

The outer peripheral surface of the press roller 19 may be provided with a pressing surface of a width P' somewhat smaller than the above-mentioned spacing P in the direction of axis thereof, as shown in FIG. 5, and between the pressing surface there may be formed a groove portion having a depth sufficient to avoid abutment with the upper edges 15. This construction permits the operating position of the press roller 19 to be set closer to the upper cutting edges 15 without damaging the cutting edges to further increase the degree of freedom with which the press roller 19 may be disposed.

it will be noted that even if the press roller 19 is disposed to press the outer peripheral surface on the downstream of the lower cutting edges 17 or to press both the outer peripheral surfaces on the up and down streams, zigzag movement of the web 1 may be prevented. Further, the surface roughness and pressing force of the press roller 19 may be set within a range depending on the characteristics of the web 1, but preferably the surface roughness is 10 to 50 $\mu$H max., and the pressing force is less than 20 Kg/m.

The web slitter of the present invention affords several advantages as noted below.

(1) Since the press roller 19 is pressed against the outer peripheral surface of the lower cutting edges 17, it becomes possible to prevent the entry of entrained air, which is the cause of zigzag movements of the web 1, into the clearance between the lower cutting edges 17 and the web 1 to materially enhance the accuracy of the slitting operation.

(2) As a consequence, it is possible to slit the web 1 into a predetermined width while conveying it with a relatively low tension and at a high speed to thereby enhance greatly the operating efficiency.

(3) Further, since the surface roughness and pressing force of the press roller 19 have respectively been set properly, the press roller may be rotated at a peripheral speed substantially equal to that of the web 1 to prevent the web 1 from being damaged by scratches, pressed flaws, breakage and creases, and the like.

What is claimed is:

1. In a web slitter of the type including a plurality of rotatably supported circular upper and lower cutting edges wherein a web is cut to a predetermined width by means of the sliding contact between corresponding edge surfaces of said upper and lower cutting edges, the improvement comprising a press roller having a substantially continuous resilient outer peripheral surface and pivotally mounted for engagement against an outer peripheral surface of said circular lower cutting edge at a predetermined pressure, a web to be cut being inserted between said press roller and said circular lower cutting edges, said outer peripheral surface of said press roller having an axial width sufficient to contact substantially all of the outer peripheral surface of said lower cutting edges whereby sufficient contacting area between the press roller and web is obtained to permit positive control of the web-running direction.

2. A web slitter according to claim 1 wherein said press roller has a resilient body having a rubber hardness of 20 to 80 degrees and which is finished to surface roughness of 10 to 50 $\mu$H max., said press roller being pressed against the outer peripheral surface of said circular lower cutting edges under a pressing force less than 50 Kg/m.

3. A web slitter according to claim 1 wherein said press roller rotates at a peripheral speed substantially equal to that of a web being cut.

4. A web slitter according to claim 1 wherein the outer peripheral surface of said press roller is provided with a pressing surface width somewhat smaller than the width between adjacent upper or lower cutting edges, grooves being formed on either side of said pressing surface to a depth sufficient to avoid abutment with said circular upper cutting edges.

* * * * *